US011512844B1

(12) United States Patent
Mittal et al.

(10) Patent No.: US 11,512,844 B1
(45) Date of Patent: Nov. 29, 2022

(54) ILLUMINATING DEVICE

(71) Applicant: OVERDRIVE ELECTRONICS PVT. LTD., Noida (IN)

(72) Inventors: Mohit K. Mittal, Noida (IN); Manish Pandey, Noida (IN); R. K. Sharma, Noida (IN)

(73) Assignee: OVERDRIVE ELECTRONICS PVT. LTD.

( * ) Notice: Subject to any disclaimer, the term of this patent is extended or adjusted under 35 U.S.C. 154(b) by 0 days.

(21) Appl. No.: 17/513,134

(22) Filed: Oct. 28, 2021

(30) Foreign Application Priority Data

Aug. 30, 2021 (IN) ..... 202111039175

(51) Int. Cl.

| | |
|---|---|
| ***F21V 29/00*** | (2015.01) |
| ***F21V 29/70*** | (2015.01) |
| ***F21V 29/85*** | (2015.01) |
| ***F21V 3/00*** | (2015.01) |
| *F21Y 105/18* | (2016.01) |
| *F21Y 115/10* | (2016.01) |

(52) U.S. Cl.
CPC ..... *F21V 29/70* (2015.01); *F21V 3/00* (2013.01); *F21V 29/85* (2015.01); *F21Y 2105/18* (2016.08); *F21Y 2115/10* (2016.08)

(58) Field of Classification Search
CPC . F21V 3/00; F21V 29/80; F21V 29/85; F21Y 2105/18; F21Y 2105/10
See application file for complete search history.

(56) References Cited

U.S. PATENT DOCUMENTS

2013/0039056 A1* 2/2013 Cho ..... F21V 7/0058 362/235
2013/0271987 A1* 10/2013 Hussell ..... F21V 29/60 362/249.02
2018/0224072 A1* 8/2018 Bernard ..... F21V 29/85

* cited by examiner

*Primary Examiner* — Gerald J Sufleta, II
(74) *Attorney, Agent, or Firm* — Sand, Sebolt & Wernow Co., LPA

(57) ABSTRACT

Described herein is an illuminating device with reflector. Said device includes a heat sink insert moulded cylindrical plastic housing, and a circular metal core printed circuit board, MCPCB, mounted on a circular slot provided on a top inner end of the housing, the circular MCPCB having light emitting diodes (LEDs), wherein LEDs mounted in a circular manner near peripheral region of a top surface of the MCPCB and having electronic components mounted in a central region of the top surface of the MCPCB. Further said device includes a cylindrical reflector fixed on the top surface of the MCPCB with its cylindrical wall lying between the LEDs and the electronic components; and a diffuser connecting a top surface of the cylindrical reflector with the top inner end of the housing, wherein lower end of said plastic housing connected with a holder.

12 Claims, 7 Drawing Sheets

Note:-1. Green marked light pattern is for LED bulb with reflector.
2. Red marked Light pattern is for traditional bulb.

ILLUMINATING DEVICE

CROSS REFERENCE TO RELATED APPLICATION

This application claims priority under 35 U.S.C. 119 from Indian Patent Application No. 202111039175, filed on Aug. 30, 2021 entitled, "AN ILLUMINATING DEVICE", the contents of which is provided herein by reference.

TECHNICAL FIELD

The present disclosure, in general, relates to an illuminating device. In particular, the present disclosure relates to an illuminating device having an internal reflector that facilitates uniform light distribution in area where light is required.

BACKGROUND

Background description includes information that may be useful in understanding the present invention. It is not an admission that any of the information provided herein is prior art or relevant to the presently claimed invention, or that any publication specifically or implicitly referenced is prior art.

The illuminating device is having property to provide lighting in various direction. Lighting includes the use of artificial light sources like lamps, light fixtures and the like. The illumination device may include the light source such as Light Emitting Diode (LED) or any other electronic device applicable in different areas. Further, a brief about the LED is discussed herein below.

LED devices are more efficient than most forms of widely used lamps, for example, incandescent, high-intensity discharge (HID) light sources, and the like. One advantage of using LED devices is that LEDs are more efficacious than incandescent light and more efficacious than some fluorescent and low wattage HID light sources. Another advantage of LED device usage is that the LEDs may be configured as low voltage, low energy devices. Another advantage of the LED devices is that of the longer life when compared to other light forms.

In LED illuminations, heat transmission and its management during the operation of a LED bulb is always a major concern. The conventional systems of existing LED bulb are designed in such a way that most of the components are mounted on a metal core printed circuit board (MCPCB) and/or below the MCPCB where heat sink is installed on the fixture where the ambient temperature in much higher compared to the ambient temperature over the MCPCB area where Optics/Diffuser is installed, due to which the operating temperature of the electronic parts is much higher thus limiting and reducing the life time of the electronics parts.

Further, along with heat management, it becomes necessary that the device is cost-effective, easy to assemble and capable of mass production in order to meet the large market demands as compared to the conventional DOB LED bulbs available in the market.

In tradition, the electronic parts are mounted on a LED lamp, where the ambient operating temperature of the critical parts like ELCO, MOV is higher and further creates the problem of longevity of the various electronic component parts. Further, the design of the LED lamp is such a manner which may harm the human eyes during direct exposer of the lamp. In addition to this, the traditional lamp does not provide uniformly in-terms of desired beam angle due to typical directional nature of LED, which is required to direct the light in the desired area.

Therefore, there is a need for such a device with reflector which can overcome the above-described limitations and obtain maximum operating efficiency in a cost-effective manner which is unique in its design and exhibits prime quality for use over a sufficient period of time.

OBJECTS OF THE DISCLOSURE

Some of the objects of the present disclosure, which at least one embodiment herein satisfy, are listed here in below.

It is a primary object of the present disclosure to provide an illuminating device with internal reflector and special shape of the external diffuser provides uniform light distribution in desired areas.

It is another general object of the present disclosure to ensure a cost-effective and efficient operation of said illuminating device with reflector.

It is still another object of the present disclosure to ensure uniform light distribution at application area by using the reflector which divert the light sideways.

It is yet another object of the present disclosure to reduce the ambient temperature around the critical parts (electronic component) fixed on the MCPCB board of said device by around 20%.

It is still another object of the present disclosure to provide a unique configuration of said device wherein all the electronic components mounted on the MCPCB, wherein said all the electronics components of MCPCB are hidden inside the reflector, due to which the temperature of the critical parts of MCPCB may be reduced about 20%.

It is yet another object of the present disclosure to provide a unique light pattern generated with the combined effect of said diffuser and reflector, wherein said diffuser and reflector combinedly acts as a light guide of said device.

It is still yet another object of the present disclosure to be used in house hold application, general lighting application and poultry house.

These and other objects and advantages of the present invention will be apparent to those skilled in the art after a consideration of the following detailed description taken in conjunction with the accompanying drawings in which a preferred form of the present invention is illustrated.

SUMMARY

This summary is provided to introduce concepts related to an illuminating device with reflector. The concepts are further described below in the detailed description. This summary is not intended to identify key features or essential features of the claimed subject matter, nor is it intended to be used to limit the scope of the claimed subject matter.

In an embodiment, the present disclosure relates to an illuminating device with reflector. Said device includes a heat sink insert moulded cylindrical plastic housing. The proposed device further includes a circular metal core printed circuit board, MCPCB, mounted on a circular slot provided on a top inner end of the housing, the circular MCPCB having light emitting diodes (LEDs), LEDs, mounted in a circular manner near peripheral region of a top surface of the MCPCB and having electronic components mounted in a central region of the top surface of the MCPCB. In addition to this, said device includes a cylindrical reflector fixed on the top surface of the MCPCB with its cylindrical wall lying between the LEDs and the electronic components. Moreover, the proposed device includes a uniquely designed diffuser connecting a top surface of the cylindrical reflector with the top inner end of the housing, wherein lower end of said plastic housing connected with a holder.

In an aspect, the heat sink having a cylindrical profile matching with the internal profile of the plastic housing.

In another aspect, the heat sink is made from a material that radiates heat generated from the LEDs outwardly. Further said heat sink is used here made of aluminium which can be over moulded with engineering plastic.

In another aspect, said reflector is fixed at the centre of the MCPCB, wherein one and more holes are provided at the top surface of the MCPCB to fix the reflector at defined position.

In another aspect, said reflector is made of plastic and may be made of in any colour and shape to help provide useful light in required area which is to be illuminated.

In another aspect, said reflector diverts the light sideways, which facilitates the uniform light distribution in required area where illumination is required.

In another aspect, said electronic components comprises a metal oxide varistor (MOV) and a wire wound resistor (WWR), wherein said electronic component are fixed onboard of MCPCB, toward the Optics/diffuser side.

In another aspect said diffuser and reflector combinedly acts as a light guide of said device.

In another aspect, a holder connected at a lower end of the housing, wherein the holder comprises electrical connection points.

In another aspect, the diameter of the diffuser increases towards the housing.

Various objects, features, aspects, and advantages of the inventive subject matter will become more apparent from the following detailed description of preferred embodiments, along with the accompanying drawing figures in which like numerals represent like components.

It is to be understood that the aspects and embodiments of the disclosure described above may be used in any combination with each other. Several of the aspects and embodiments may be combined to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and methods that are consistent with the subject matter as claimed herein, wherein:

The figures depict embodiments of the present subject matter for the purposes of illustration only. A person skilled in the art will easily recognize from the following description that alternative embodiments of the structures and methods illustrated herein may be employed without departing from the principles of the disclosure described herein.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The present disclosure aims to solve a technical problem of higher operating temperature generated by the electronic components, which are mounted on a metal core printed board (MCPCB) in a conventional LED bulb, in such a way that it increases the operating efficiency of the illuminating device (example as LED bulb) in a cost-effective manner.

Figure 1:
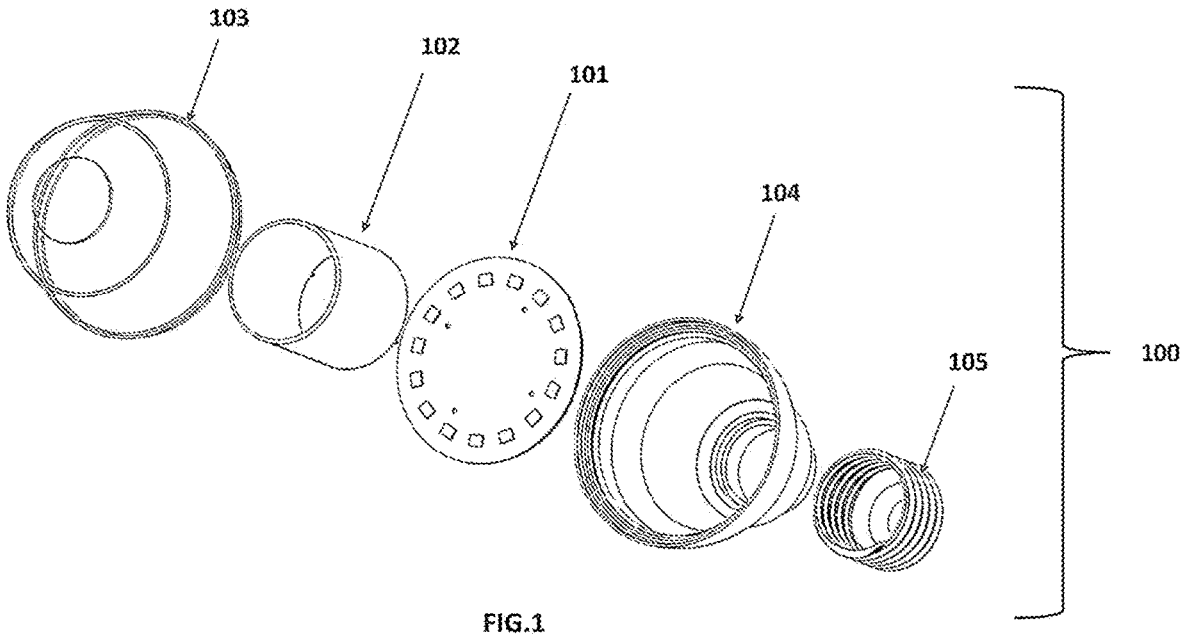
FIG. 1 illustrates an schematically exploded view of assembling parts of an illuminating device, in accordance with an exemplary embodiment of the present disclosure.
Figure 2:
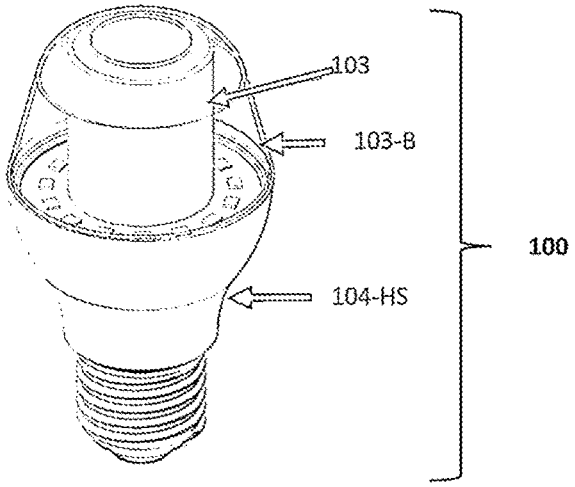
FIG. 2 illustrates an perspective view of the illuminating device with reflector, in accordance of the present disclosure.

To address this, the present disclosure provides an illumination device 100 as shown in FIG. 1 and FIG. 2. Said device 100 includes a heat sink insert moulded cylindrical plastic housing 104. The proposed device 100 further includes a circular metal core printed circuit board, MCPCB, 101 mounted on a circular slot provided on a top inner end of the housing 104, the circular MCPCB 101 having light emitting diodes (LEDs), wherein LEDs are mounted in a circular manner near peripheral region of a top surface of the MCPCB 101 and having electronic components mounted in a central region of the top surface of the MCPCB 101. Adding to this, said device 100 includes a cylindrical reflector 102 fixed on the top surface of the MCPCB 101 with its cylindrical wall lying between the LEDs and the electronic components. Moreover, the proposed device 100 includes a diffuser 103 connecting a top surface of the cylindrical reflector 102 with the top inner end of the housing 104, wherein lower end of said plastic housing 104 is connected with a connection holder 105.

In an embodiment of the present disclosure, the reflector 102 diverts the light sideways for mounting of lamp at application area and where the lamp mounting height are low and leading to uniform light distribution. Further, the reflector 102 is fixed on the metal core printed board (MCPCB) in definite position, at the centre of the MCPCB 101. Yet further, the present disclosure is resulting in an improved light distribution pattern in angular direction. The proposed device 100 is described in detail along with figures herein below:

FIG. 1 shows an exploded view of a complete set of said illuminating device 100 with an insight into the interconnection of all the electronic components of said device. The assembled parts of the illumination device 100 incorporating the insert moulded cylindrical plastic housing 104, the circular MCPCB 101, the cylindrical reflector 102, the diffuser 103 and the holder 105 are shown in parts in FIG. 1, in accordance with an exemplary embodiment. The device 100 can be easily assembled and provides a utility fixture using Incand. Further, the proposed device is explained in FIG. 2.

FIG. 2 shows a perspective view of the proposed device 100 as mentioned as illuminating device 100. Said illuminating device 100 with reflector 102 facilitates the feature of uniform light distribution by using the reflector 102 as it divers the light sideways. Said cylindrical reflector 102 is fixed on the top surface of the MCPCB 101 at definite position, and all the driver electronic components of MCPCB are hidden inside said reflector 102, which results in reduced operating temperature 20% less than usual temperature, which enhance the longevity of said device. Here, driver electronic components of MCPCB 101 are mentioned as critical electronic component. Further, said plastic diffuser 103 and the reflector 102 combinedly provides the guiding root of said device. The reflector 102 used in the proposed device 100 is in any colour not limiting blue colour. The holder 105 used in the proposed device may be either E26 base cap or E27 base cap fitted at the lower end of the moulded housing 104.

Figure 3:
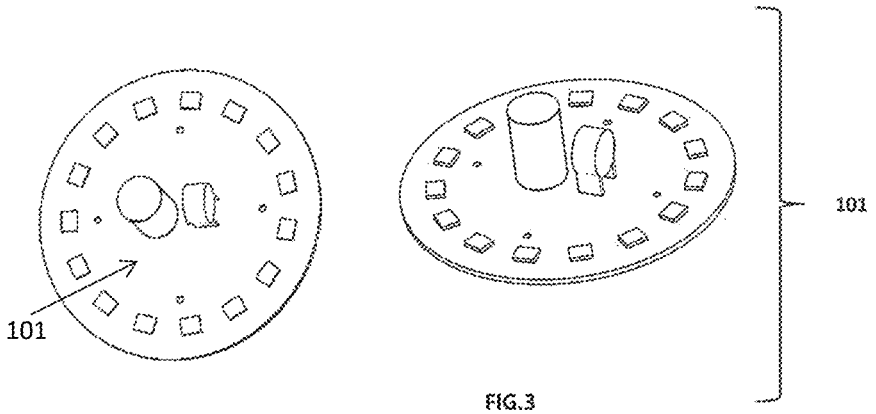
FIG. 3 illustrates a perspective view of a metal core printed circuit board of the illuminating device, in accordance with an exemplary embodiment of the present disclosure.
Figure 4:
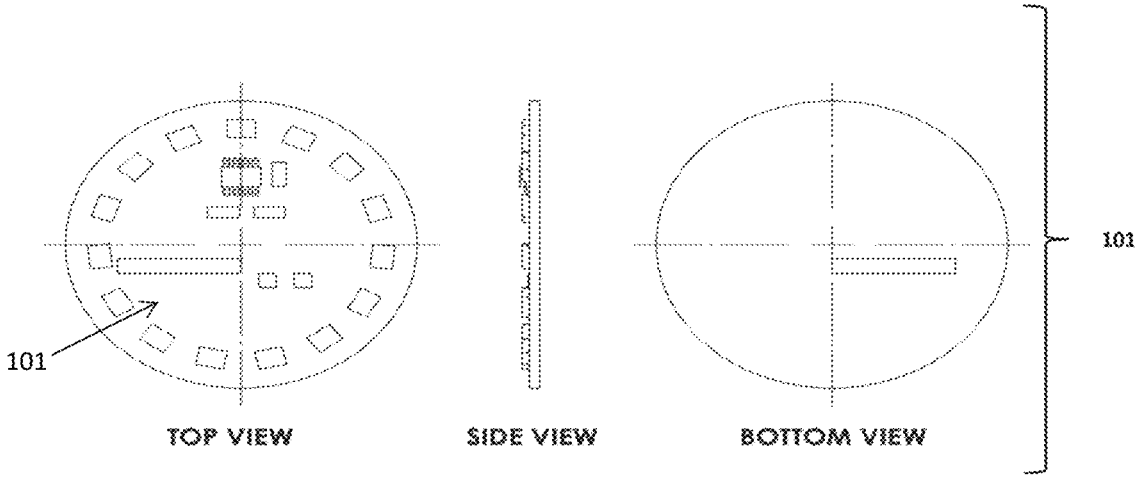
FIG. 4 illustrates an orthogonal view of the metal core printed circuit board of the illuminating device, in accordance with an exemplary embodiment of the present disclosure.

FIG. 3 and FIG. 4 illustrate a perspective view of the MCPCB 101 wherein all the electronic components are mounted at the centre region of the MCPCB 101, and further the MCPCB 101 is inserted into the moulded housing 104 for better heat management. The entire electronic components are mounted on the MCPCB 101 and the reflector 102 helps to hide all the electronics components inside, due to which the temperature of the critical parts may be reduced about 20% and the temperature of the critical parts may be 20% cooler and the assembly process is also easier. All the electronic components reside in the critical part which are mounted at the centre of the MCPCB 101. Said electronic components comprise an electrolytic capacitor (ELCO), a metal oxide varistor (MOV) and a wire wound resistor (WWR). The orthogonal views of the MCPCB 101 are shown in FIG. 4. The unique configuration of electronics components of the illuminating device 100 helps to enhance the electronic components life.

Figure 5:
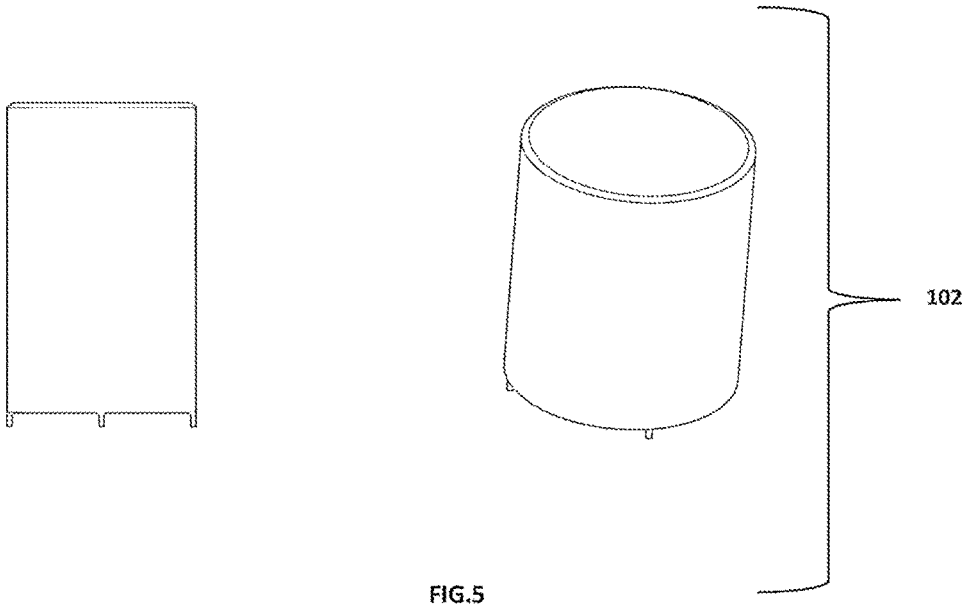
FIG. 5 illustrates a perspective and side view of a reflector of the illuminating device, in accordance of the present disclosure.
Figure 6:
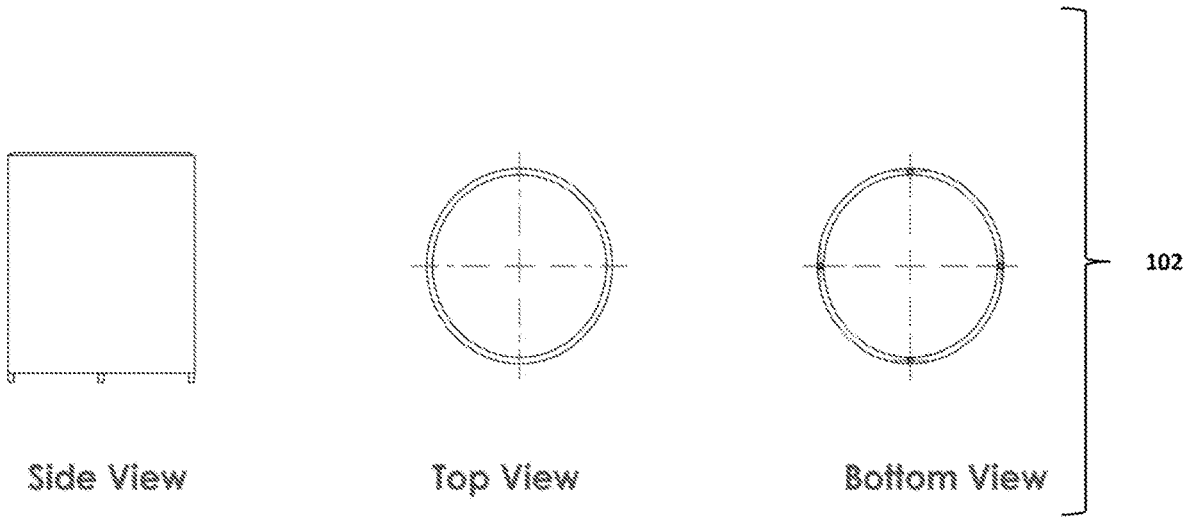
FIG. 6 illustrates an orthogonal view of the reflector of the illuminating device, in accordance with an exemplary embodiment of the present disclosure.
Figure 13:
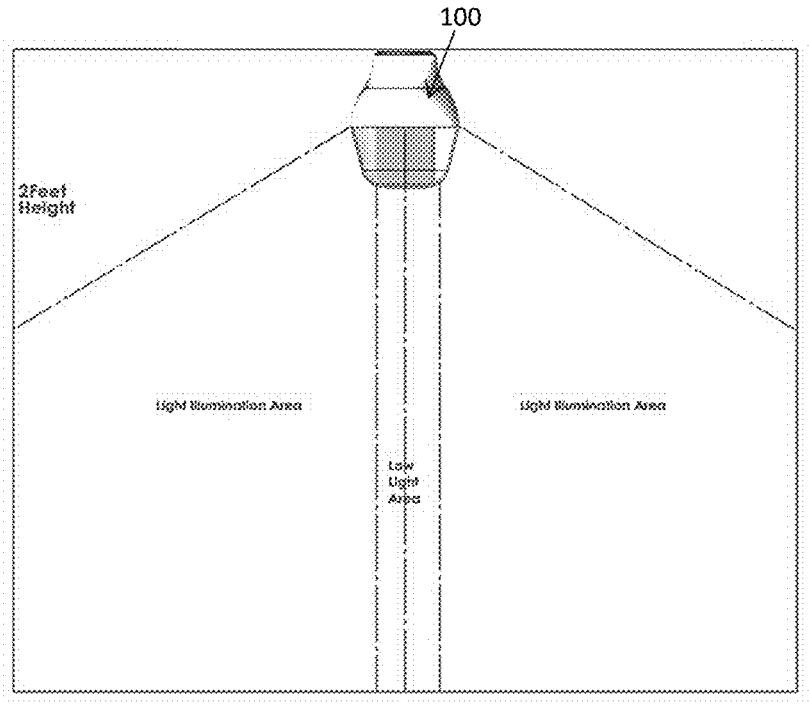
FIG. 13 illustrates an illuminating device and its projection towards uniform light distribution in accordance with an exemplary embodiment of the present disclosure.

FIG. 5 and FIG. 6 show perspective and orthogonal views of the special shaped plastic reflector 102. Said reflector 102 is fixed at the definite position on the MCPCB 101 for providing uniform better heat management. Said reflector 102 is fixed at the centre of the MCPCB 101. Said reflector 102 reflects light sideways which helps in uniform light distribution in target area where illumination is most required. And said reflector 102 also guides the light distribution in all allowed direction, only needs to block the light in front side of lamp, which is the requirement of feeder light lamp. The reflector 102 is a cylindrical shaped with predefined shape. In addition to this, the reflector 102 helps to divert the light sideways for mounting of the lamp at application area where the lamp mounting height are low and may help in uniform light distribution, and also have to block unwanted light in a particular direction as shown in FIG. 13 in an exemplary implementation.

Figure 7:
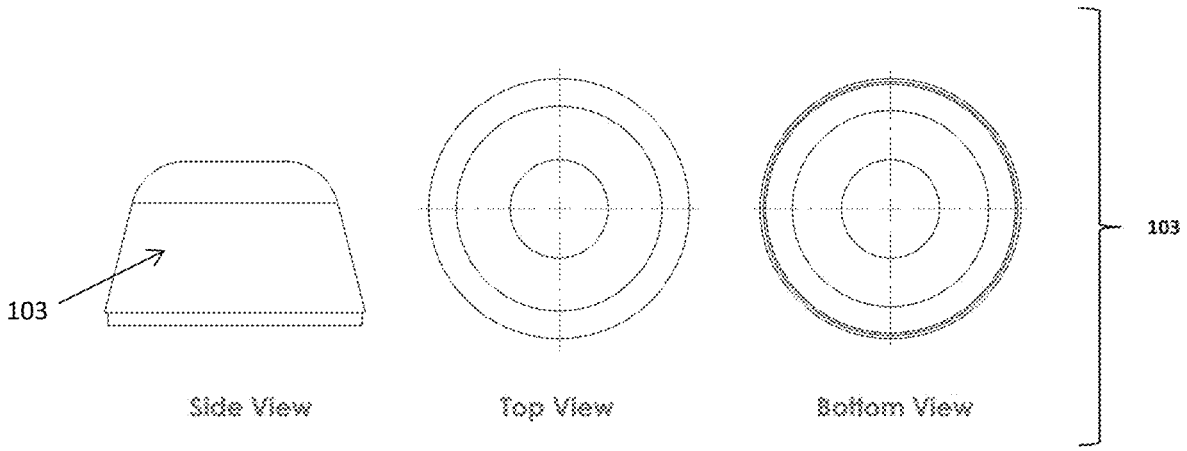
FIG. 7 illustrates an orthogonal view of a plastic diffuser of the illuminating device, in accordance with an exemplary embodiment of the present disclosure.

FIG. 7 illustrates an orthogonal view of the special shaped plastic diffuser 103 which is used in the illuminating device 100 for providing light pattern guidance. The diffuser 103 is set at the top of illuminating device 100 by fixing in the moulded housing 104 of said device 100 with the help of glue. Moreover, said diffuser 103 and the reflector 102 provides combinedly acts as guiding root of said device 100, which helps in meeting the requirement of feeder light lamp.

Figure 8:
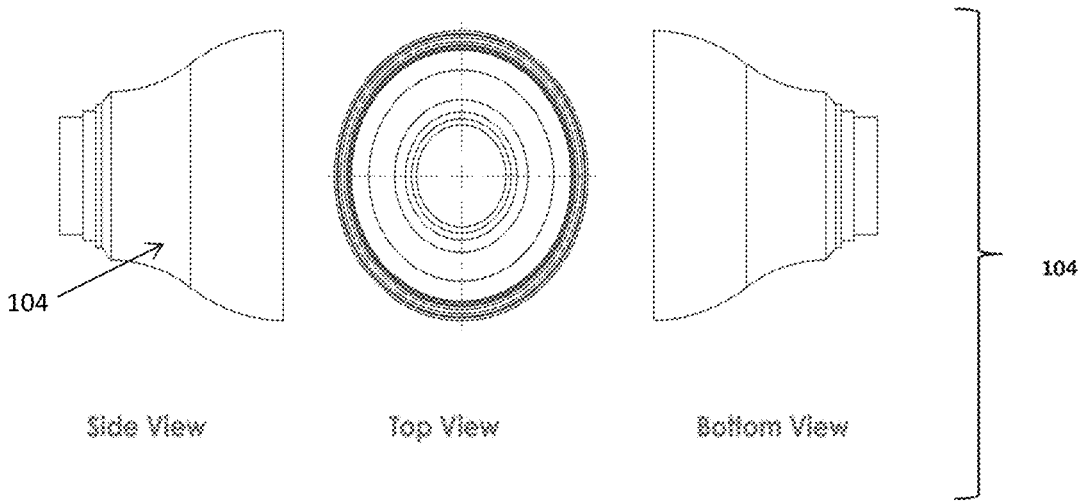
FIG. 8 illustrates an orthogonal view of a heat sink insert moulded cylindrical plastic housing of the illuminating device, in accordance with an exemplary embodiment of the present disclosure.

FIG. 8 shows an orthogonal view of the moulded housing 104 of the illuminating device 100. Said moulded housing 104 is incorporated with an aluminium heat sink with plastic cover.

Figure 9:
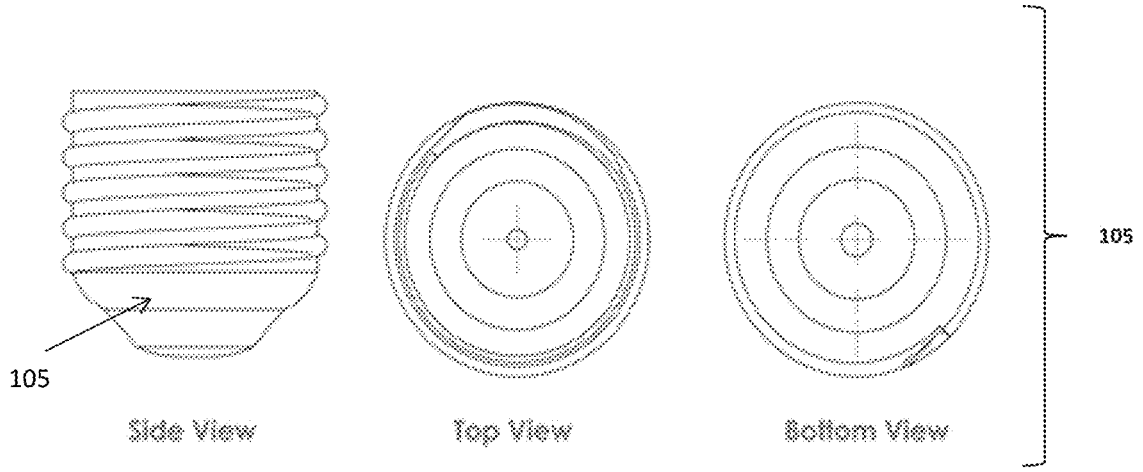
FIG. 9 illustrates an orthogonal view of a connection holder of the illuminating device, in accordance with an exemplary embodiment of the present disclosure.

FIG. 9 shows an orthogonal view of the holder 105 of the illuminating device 100. The holder 105 of the said device 100 may be any type either E26/E27 base cap. The connection between the holder 105 and moulded housing 104 is performed through crimping. The crimping helps the lamp to connect with the holder 105 in base up/down position. In the present disclosure, the E26 base cap is used, but it is not limited to E26 base alone. Said holder is connected at a lower end of the housing, wherein the holder comprises electrical connection points.

Figure 10:
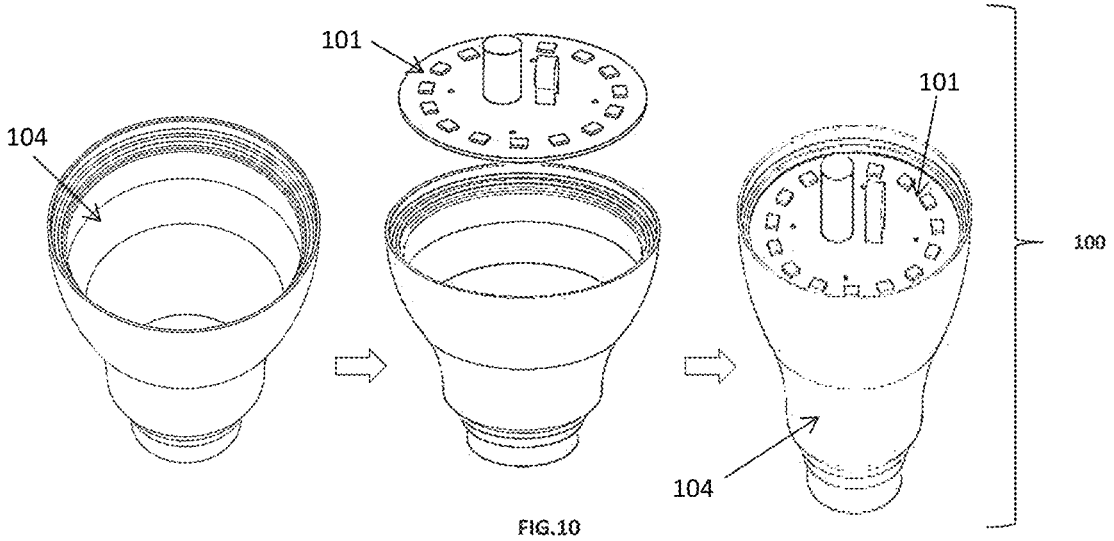
FIG. 10 illustrates an perspective view of an assembly process, in accordance with an exemplary embodiment of the present disclosure.

In as aspect, the assembly process of the illumination device 100 is described with reference to FIGS. 10, 11 and 12. As shown in FIG. 10, the fixing of the MCBCB 101 into the circular slot of the top inner end of the housing 104. Thereafter, in FIG. 11, it shown that the holder 105 is fixed on lower end of the housing 104. Then, in FIG. 12, first the reflector 102 is positioned in a top central region of the MCBCB 101, and then finally the diffuser 103 is placed on the top of the device 100 to cover the reflector 102 and the MCPCB 101.

Further, the light projection of said device 100 is shown in FIG. 13, wherein it shows the uniform light distribution.

Figure 14:
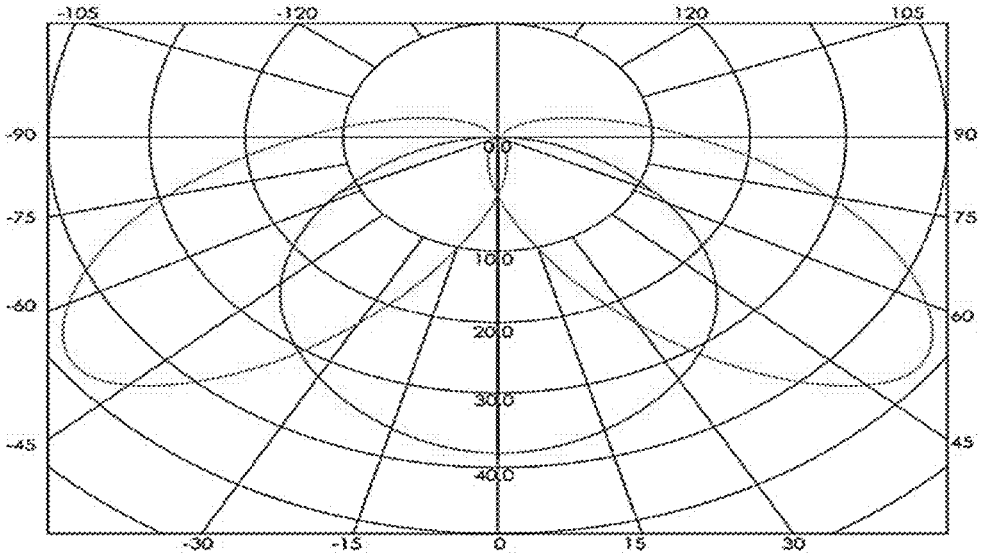
FIG. 14 illustrates a light distribution pattern generated by the illuminating device in accordance with an exemplary embodiment of the present disclosure.

The light distribution pattern generated by the device 100 has special lob shaped light pattern as represented in technical terms shown in FIG. 14.

The locking and assembly arrangements, projections, design of said is unique in its nature which has been designed after detailed study, experiments carried out. The design is formed in such manner that light output coming out of lamp has better beam angle & don't harm the human eye after direct exposure to lamp. The application of said proposed device is mentioned herein below.

The illuminating device 100 with the reflector 102 of the present disclosure has applications in LED bulb used in house hold application, general lighting application and poultry house.

TECHNICAL ADVANTAGES

The technical advantages of the proposed illuminating device are listed herein below:

The main feature of the present disclosure is provide a unique designed in-terms of the locking and assembly arrangement, projection of said device.

The important feature of the present disclosure is to facilitate uniform light distribution in targeted areas where lighting is required. The present disclosure is to provide said illuminating device with reflector wherein the reflector is mounted on the top surface of the MCPCB at defined position, wherein said reflector is used to divert the light sideways for mounting of the device at application area and provides uniform light distribution.

Another important feature of the said device is to provide an illuminating device with reflector wherein the operating temperature of the critical electronic parts which are installed in Diffuser section (upper part) of MCPCB where the ambient temperature is over 20% cooler, which is explained further in below.

The present disclosure is to disclose said illuminating device with reflector, wherein all the critical electronic components of MCPCB are hidden inside the reflector, due to which the operating temperature is reduced to over 20% less than usual temperature, and assembly process is also easier.

Another advantage of the proposed device is to use of reflector, wherein reflector is made of plastic and is in tapered and predefined cylindrical shape, wherein all the critical electronic components of MCPCB are hidden inside said reflector.

The present invention is to disclose said illuminating device with reflector, wherein said diffuser and reflector combinedly acts as a light guide of said device, which is another advantage of said device.

The present invention is to disclose the holder used in said device, which is any one type either B22 or E26 base cap or E27 base cap which is fitted at the end of the moulded housing.

Another advantage of the present invention is to provide better beam pattern which provides the lighting is areas where it is required.

Another advantage of present invention is to provide enhanced longivity of said device.

The present invention is to provide a unique shape of said device which is cost effective and may be applicable in multiple purpose.

Another advantage of the present disclosure is to provide better heat dissipation by using Al heat sink over moulded housing with the plastic.

The design of the proposed device is made in such a manner the light output coming out of said device has lighting distribution sideways and more uniform illumination is provided in targeted/required area.

Further, it will be appreciated that those skilled in the art will be able to devise various arrangements that, although not explicitly described or shown herein, embody the principles of the invention and are included within its scope.

Furthermore, all examples recited herein are principally intended expressly to be only for pedagogical purposes to aid the reader in understanding the principles of the invention and the concepts contributed by the inventor(s) to furthering the art and are to be construed as being without limitation to such specifically recited examples and conditions. Also, the various embodiments described herein are not necessarily mutually exclusive, as some embodiments can be combined with one or more other embodiments to form new embodiments.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

EXPERIMENTAL RESULT

In the exemplary 5 W FEEDER LIGHT A55 LED BULB is shown in FIG. 13 with below specification:

AL. Insert Moulded Special Plastic Body-1 pc

Special PC Diffuser-1 pc

Figure 11:
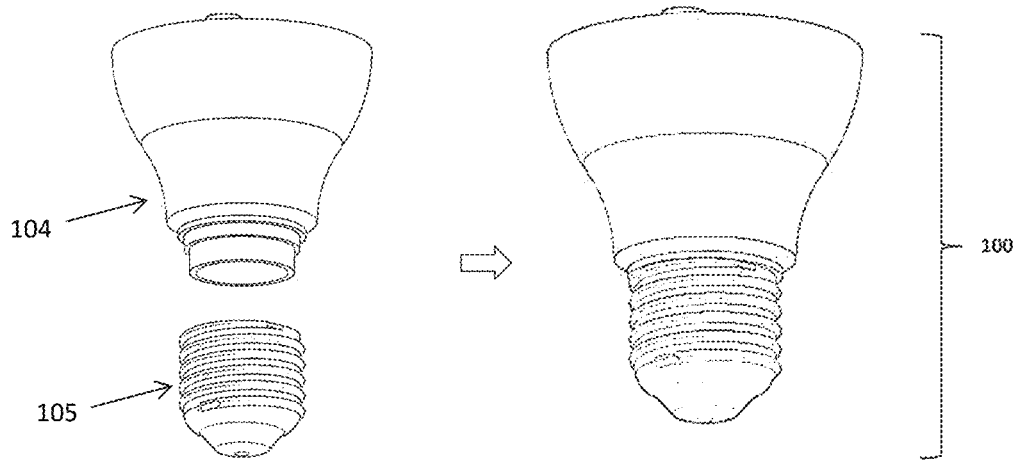
FIG. 11 illustrates an assembling of the holder with the housing 104, in accordance with an exemplary embodiment of the present disclosure.
Figure 12:
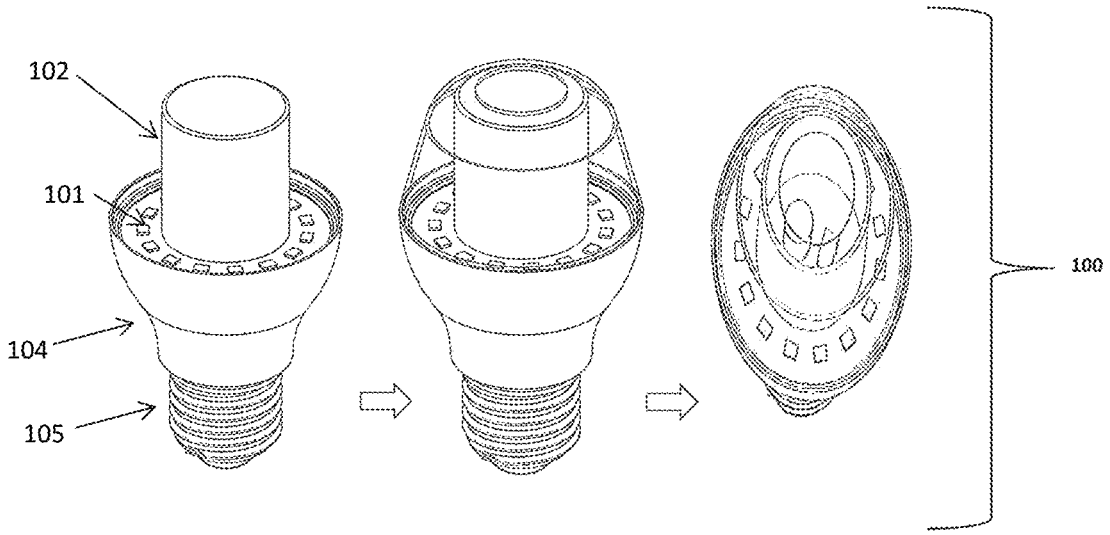
FIG. 12 illustrates assembling of the reflector in the housing, in accordance with an exemplary embodiment of the present disclosure.

DOB MCPCB with all components mounted on front side (in diffuser shell section)-1 pc E26/B22 Metal Cap-1 pc In an example of the exemplary LED bulb with reflector as shown in FIGS. 10,11 and 12, the various part of the assembly are described herein below:

During assembly, the first stage is the insertion of MCPCB (Complete components mounted on front face of MCPCB) with the help of slot provided into the housing & pneumatic pressing will fit the lamp at defined position, which also set the lamp thermally & electrically stable, which results in better light distribution & long life of lamp.

FIG. 10 illustrates said heat sink insert moulded cylindrical plastic housing, wherein a red slot is used to fix said MCPCB 1002 on the provided slot on heat sink, it will make proper contact area with MCPCB, this kind of MCPCB insertion 1003 is best to protect the component from getting damage, which leads to compensate the process time during production.

Further, the device is discussed about insert moulded cylindrical plastic housing termed as PA/PBT body. This special shaped set of LED lamp heat sink would be able to provide multiple options, & effectively as per details explained in detailed on the later part. This is possible due to combination of best class Electrically Insulated plastic material like PBT or PA having a lower conductivity up to 2 w/m-k but with complete electrical insulation properties to end user. Experiments carried to optimize the material's cost, manufacturing costs, meeting ANSI dimensional requirements, manufacturing process. The combinations created in special manner to meet the objectives as it in insert moulded with AL insert for better thermal operation, this special shaped set of AL insert would be able to provide multiple option, & effectively. This is possible due to combination of best class conductivity up to 205 w/m-k. Experiments carried to optimize the material's cost, manufacturing costs, meeting ANSI dimensional requirements.

Second stage is the insertion of shoulder the base cap with the lamp housing after doing crimping. FIG. 11 illustrates the same in 2 stages, wherein crimping helps the lamp to connect with the holder in base up/down position.

Third stage is the insertion of the reflector on defined position for light pattern distribution. Special shaped plastic reflector is fixed at the definite position on the MCPCB for providing better heat management. Said reflector is fixed at the centre of the MCPCB. Said reflector reflects light sideways which helps in uniform light distribution. And said reflector also guides the light distribution in all allowed direction, only needs to block the light in the area of cylindrical reflector. That is also feeder light lamp requirement. The reflector is a cylindrical shaped and fitting of reflector 102 is shown in FIG. 12

Forth stage is the fitting of the diffuser with the help of glue on aluminium inserted housing 104 as shown in FIG. 12.

Further an A56-56MMD is LED BULB WITH INTERNAL REFLECTOR SYSTEM is provided herewith and shown in FIG. 13.

We claim:

1. An illuminating device comprising:

a heat sink insert moulded within a cylindrical plastic housing;

a circular metal core printed circuit board (MCPCB) mounted on a circular slot provided on a top inner end of the housing, the circular MCPCB having light emitting diodes (LEDs) mounted in a circular manner near peripheral region of a top surface of the MCPCB and having electronic components mounted in a central region of the top surface of the MCPCB;

a cylindrical reflector having a bottom surface fixed on the top surface of the MCPCB and the cylindrical reflector being entirely surrounded by the LEDs and the electronic components;

a diffuser connecting a top surface of the cylindrical reflector with the top inner end of the cylindrical plastic housing; and an Edison type connection holder connected to a lower end of said cylindrical plastic housing.

2. The device as claimed in claim 1, wherein the heat sink has a cylindrical profile matching with an internal profile of the cylindrical plastic housing.

3. The device as claimed in claim 1, wherein the heat sink is made from a material that radiates heat generated from the LEDs outwardly.

4. The device as claimed in claim 3, wherein said heat sink is made of aluminium.

5. The device as claimed in claim 1, wherein said reflector is fixed at the centre of the MCPCB, wherein one and more holes are provided at the top surface of the MCPCB to fix the reflector at a defined position.

6. The device as claimed in claim 5, wherein said reflector is made of plastic of any colour.

7. The device as claimed in claim 1, wherein said reflector diverts light from the LEDs sideways.

8. The device as claimed in claim 1, wherein said electronic components comprises a metal oxide varistor (MOV) and a wire wound resistor (WWR).

9. The device as claimed in claim 1, wherein the diffuser and the reflector combine to transmit light from the LEDs out of the device.

10. The device as claimed in claim 1, wherein the holder comprises electrical connection points.

11. The device as claimed in claim 1, wherein said holder is any one type either E26 base cap or E27 base cap fitted at the end of said device.

12. The device as claimed in claim 1, wherein a diameter of the diffuser increases towards the housing.

* * * * *